United States Patent [19]

McClellan

[11] Patent Number: 4,689,908

[45] Date of Patent: Sep. 1, 1987

[54] HOLSTER AND HANDGRIP EXTENSION FOR MINIATURE HANDGUNS

[76] Inventor: Gary C. McClellan, 4011 Saddler La., Vale, Oreg. 97918

[21] Appl. No.: 923,189

[22] Filed: Oct. 27, 1986

[51] Int. Cl.[4] ..... F41C 23/00; F41C 33/02

[52] U.S. Cl. ..... 42/71.02; 42/72; 224/198

[58] Field of Search ..... 42/70.11, 71.02, 72, 42/73; 224/198

[56] References Cited

U.S. PATENT DOCUMENTS

| | | | |
|---|---|---|---|
| 52,582 | 2/1866 | Loomis | 42/72 |
| 966,165 | 8/1910 | Cobb | 42/71.02 |
| 1,266,633 | 5/1918 | Sachs | 42/72 |
| 1,454,454 | 5/1923 | Rosier | 42/72 |
| 3,184,877 | 5/1965 | Andrews | 42/72 |
| 4,198,026 | 4/1980 | Capolupo | 42/70.11 X |

*Primary Examiner*—Deborah L. Kyle
*Assistant Examiner*—Ted L. Parr
*Attorney, Agent, or Firm*—Paul F. Horton

[57] ABSTRACT

Holster-handgrip extension apparatus for miniature handguns of the type having a handgrip framework defining an opening therethrough. The apparatus includes a pair of pivot bolt support plates located within the framework opening and separated by a separator-spacer member for holding the plates flush with the sides of the framework; a pivot bolt supported by the plates; and a rigid shell pivotally engaging the pivot bolt, the shell having a longitudinal, top opening, slot for receiving the handgrip, trigger, part of the handgun stock, and the barrel when in the closed holster position and the shell providing an extension of the handgrip when in the open, operable, position.

10 Claims, 4 Drawing Figures

HOLSTER AND HANDGRIP EXTENSION FOR MINIATURE HANDGUNS

BACKGROUND OF THE INVENTION

1. Field of the Invention

This invention relates, in general, to holsters and handgrips, and in particular to a handgrip extension for miniature pistols and revolvers; the handgrip extension serving as a holster when in the closed position.

2. Description of the Prior Art

Miniature pistols, including miniature revolvers, are currently popular because of their fine craftsmanship and extremely small size; having an overall length, at minimum, of four and one-half inches, including a barrel length of one inch. The primary problem with miniature pistols is the lack of accuracy which is due in large part to the difficulty in holding and aiming because of the very small handgrip which, conventionally, has an inside curvature of approximately two inches—completely inadequate for the hand of the average man. Besides the apparent danger in having inadequate control over holding and aiming the pistol, the pistol hammer is easily cocked and no guard is provided for the trigger which renders the pistol unsafe when loaded.

No combination handgrip extension and holster devices are known to the inventor. U.S. Pat. No. 52,582, issued to B. T. Loomis, discloses a folding revolver in which the handgrip itself, as well as the trigger, fold to underlie the rotating cylinder of the revolver. U.S. Pat. No. 1,454,454, issued to H. Rosier, discloses similar structure and function. U.S. Pat. No. 2,683,948, issued to R. M. Catron, discloses a holster having a collapsible bracing member which, when extended, converts to a shoulder rested stock. U.S. Pat. Nos. 1,266,633 and 1,554,556 issued to G. Sachs and E. Camus, respectively, also show stock extensions for pistols. Shoulder rest stocks, beside serving a different function than handgrips, because of their bulk are useless with the miniature pistol in defeating the primary characteristic of the pistol; that of smallness of size and hence compactness. The folding grips of Loomis and Rosier must be built into the revolver itself and cannot be added to an existing pistol. Additionally, such folding handgrips do not function as a holster, but simply fold against the revolver for compactness.

SUMMARY OF THE INVENTION

The handgrip extension and holster combination of the present invention is readily attachable to an existing pistol or revolver, of the type having a handgrip framework defining a cavity or opening, without mutilation of the firearm. The handgrip extension and holster apparatus of the present invention includes pivot bolt support means; a pivot bolt carried by said support means; and a slotted shell which is pivotal upon the bolt to define a holster which completely encases the handgrip, trigger, and barrel of the firearm when in the closed, holster mode and which defines a handgrip extension to accommodate the hand of the average man when in the open, operational mode. A more thorough description of the invention may be found in the appended claims.

It is therefore a primary object of the present invention to provide a holster-handgrip extension accessory to an existing miniature handgun for extending the length of the handgrip when in the operational mode and to cover the handgrip, trigger, and barrel of the handgun when in the closed, non-operational mode.

It is also an object of the present invention to provide holster-handgrip extension apparatus for an existing handgun without any machining of parts of the handgun and without any mutilation thereof.

It is another object of the present invention to provide holster-handgrip extension apparatus which includes lock means to prevent accidental firing of the handgun when in the closed mode.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
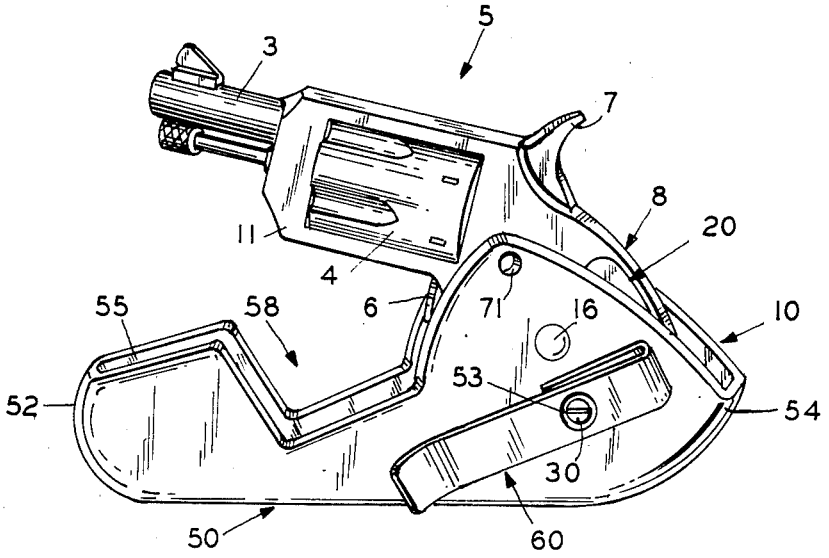
FIG. 1 is a perspective view of a preferred embodiment of the present invention, shown attached to a miniature revolver in a partially opened position.

Referring now to the drawings and to FIG. 1 in particular, an embodiment to be preferred of holster-handgrip extension apparatus 10, made according to the present invention is disclosed. Apparatus 10 includes, generally, pivot bolt support means 20, shown more clearly in FIG. 2; pivot bolt 30; and holster-handgrip extension member 50. In the drawings, the apparatus is shown attached to a miniature revolver 5; it being understood that the apparatus may likewise be attached to other miniature handguns in the same manner and therefore, for the sake of clarity, reference will be made only to the revolver.

Revolver 5 is an existing structure and forms no part of the present invention, having a barrel 3, a rotating cylinder 4, a trigger 6, hammer 7, and a handgrip 8, as is conventional.

Figure 2:
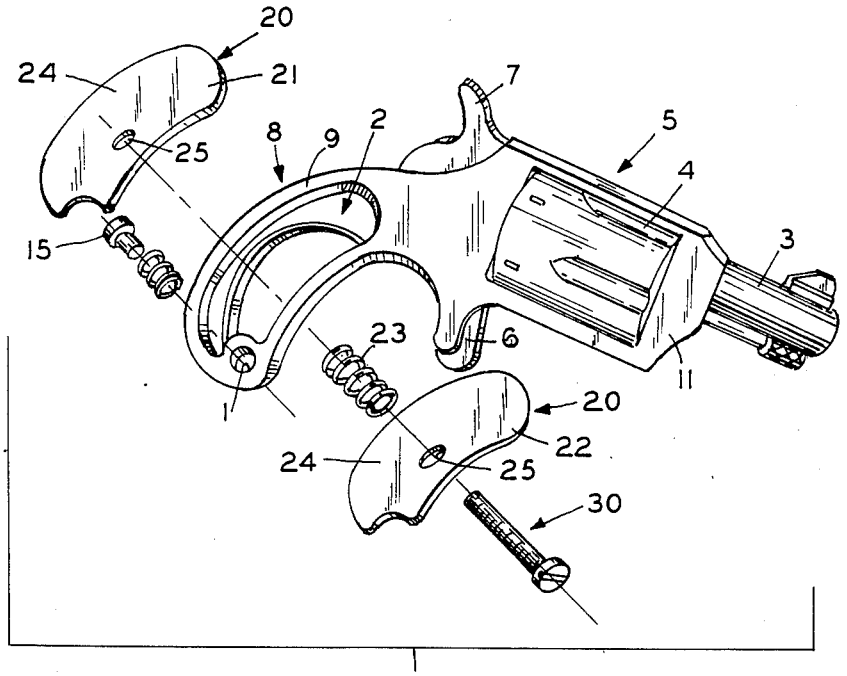
FIG. 2 is an exploded perspective view showing the support plates, separator, and pivot bolt, as mounted to the handgrip, shown in partial section.

Referring to FIG. 2, it will be seen that the miniature handgun 5, with which the present invention is usable as an accessory, has a handgrip 8 which has a framework defining a cavity or opening 2 and a second circular opening 1. The conventional side plates, not shown, forming a part of the grip, are two in number and are contoured to a desired shape. Each plate engages handgrip 8 on opposing sides of the handgrip framework and are held together by a bolt, also not shown, which extends through opening 2, pulling the plates together. The conventional side plates are removed simply by unscrewing the bolt, which threadably engages the plates, for installation of the apparatus of the present invention.

Pivot bolt support means, designated generally by the numeral 20, and shown to advantage in FIG. 2, includes two plate members 21 and 22, respectively, and a spacer or separator 23, which may be in the form of a compression spring, for holding the plates in a laterally spaced, parallel, orientation to one another. The separator may be in the form of flanges which are a part of or made a part of the handgrip of the handgun itself. Each plate member is formed or machined for a snug placement within opening 2, the end wall of each plate engaging the surrounding framework of the handgrip to prevent movement; each plate is provided with a planar exterior surface 24 which is flush with the respective sides 9 of the handgrip; and each plate is provided with an aperture 25 in alignment with a like aperture of the opposing plate for placement of pivot bolt 30 therethrough; the pivot bolt also extending through separator 23. Pivot bolt support means 30 serves to mount pivot bolt 30 in place without any mutilation of the handgun.

Figure 3:
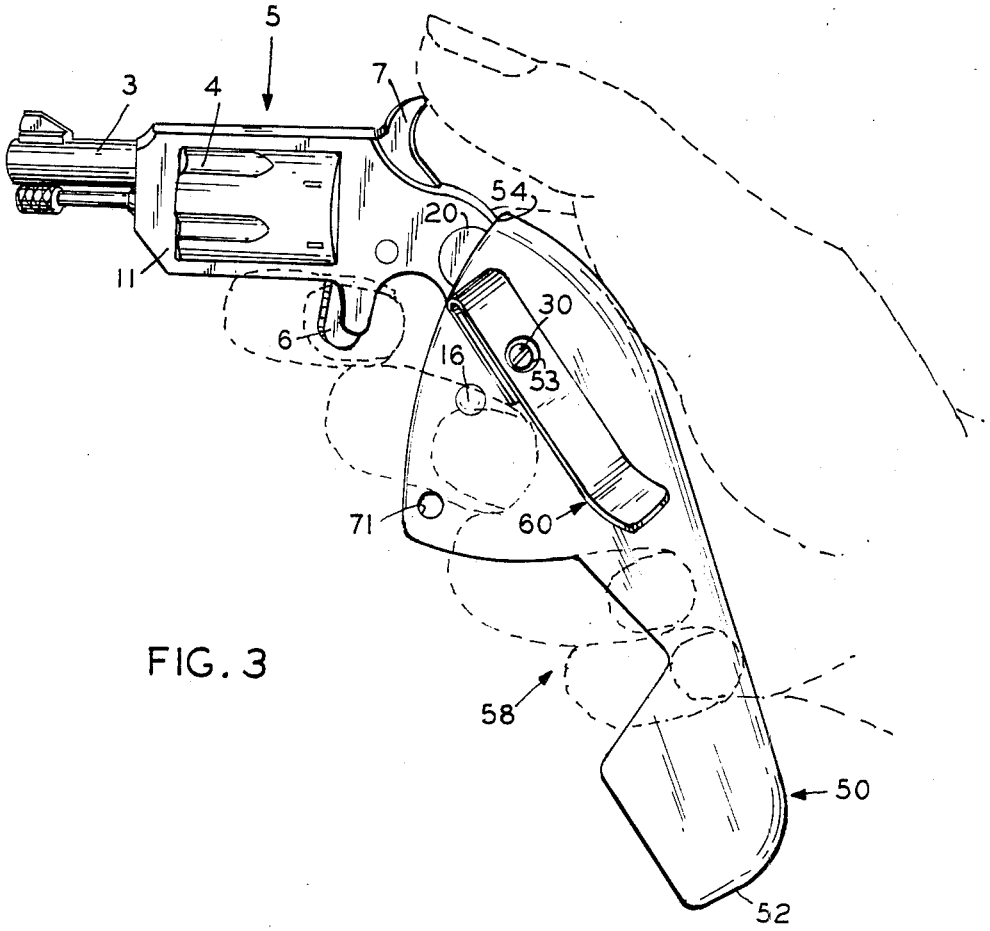
FIG. 3 is a side view of the apparatus shown in FIG. 1, showing the holster-handgrip extension member in a fully extended, operational position with hand shown by dotted lines.

Holster-handgrip extension member 50 is in the form of a rigid shell which is pivotally mounted to revolver 5 by means of pivot bolt 30, as seen in FIG. 3 taken in conjunction with FIG. 2, the pivot bolt extending through a pivot bolt aperture 53; through plate 21, separator 23, and plate member 22 of support means 20; and through a second pivot bolt aperture on the opposing side of member 50. The pivot bolt may be secured to member 50 by any conventional means such as a threaded aperture, threaded nut, or the like. Preferably, the pivot bolt also engages a clip fastener 60 for affixing the fastener to a selected side of the shell 50. Fastener 60 may engage a boot top, belt, or clothing for attachment to the person.

Holster-handgrip extension member 50 may be formed or machined from high impact plastic or metal, having a top opening longitudinal slot 55, as may be seen in FIG. 1, for closely receiving, in the manner of a holster, handgrip 8, trigger 6, barrel 3, and a portion of stock or frame 11 of revolver 5 when in the closed, non-operational mode. End wall 52 covers the end of the revolver barrel for reasons of safety and for maintaining a clear barrel during periods of non-use.

Figure 4:
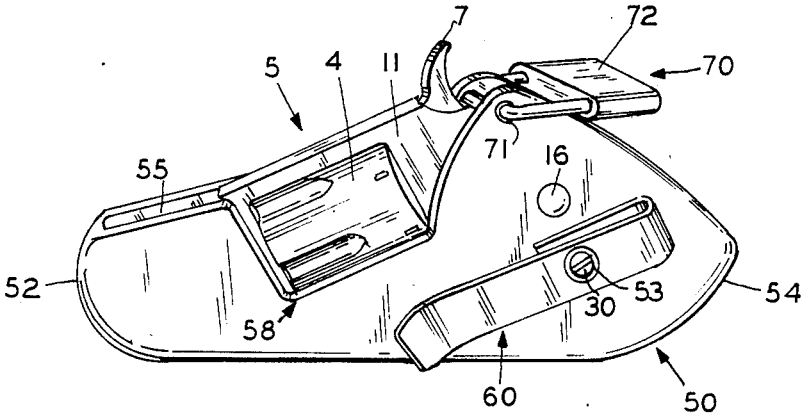
FIG. 4 is a perspective view of the apparatus shown in FIG. 1, showing the holster-handgrip extension member in the closed, non-operational, holster mode.

Extension member 50, when used with miniature revolvers, includes a recess 58, modified U-shape in form and transverse to longitudinal slot 55, in the top of the shell to closely engage and receive rotating cylinder 4 of the revolver, when in the closed position as shown in FIG. 4. Recess 58 also serves to receive the little finger and ring finger of the operator to make a surprisingly comfortable grip when member 50 is in the open, operational mode, as may be seen in FIG. 3.

To hold the extension member 50 in both the closed position and the open, handgrip extension position, a spring loaded detent pin 15 is mounted within existing aperture 1 of the handgrip framework, as will be seen in FIG. 2. Where an aperture is not presently existing in the framework, an open ended cylinder, not shown, may be affixed to one of the plate members for receiving the detent pin including the biasing spring. The detent pin engages two spaced recesses, not shown, located on the interior walls of slot 55 of member 50 to hold member 50 in the desired open or closed position. The recesses are located on a common arc about the pivot bolt. A push button 16, shown in FIG. 1, may be used to displace the detent pin from a recess for closure. Member 50 is also provided with lock means, designated generally by the numeral 70, to prevent firing of the revolver when in the closed mode, shown in FIG. 4. Lock apertures 71 are formed or drilled in the shell immediately to the rear of hammer 7 of revolver 5, as indicated in the closed mode. Any suitable locking device, such as miniature padlock 72, may be used; the arm of the padlock extending through apertures 71 to prevent retraction of the hammer.

For operation, and assuming handgun 5 is contained within holster-handgrip extension member 50 in the closed, non-operational mode, shown in FIG. 4, the cylinder is grasped and the handgun pivoted toward the open position with the detent pin being released from its recess. The handgun is then pivoted relative to member 50 on pivot bolt 30 to the open, extended, operational mode, shown in FIG. 3, with end 54 of member 50 serving as a shoulder to restrict the backward rotation of the revolver relative to the shell, and with the detent pin engaging a second recess. The trigger finger is then placed over trigger 6 with middle finger engaging the shell just above lock aperture 71 and the other two fingers contained within recess 58; the extended handgrip providing a comfortable grip for the average male adult. After use, the detent button 16 is pushed to release detent pin 15 for closure. Once closed, padlock 72 may be installed to prevent opening of the holster and to prevent the cocking of hammer 7.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. Holster and handgrip extension apparatus for miniature handguns of the type having a handgrip framework, to which handgrip side plates are removably attached, said framework defining an opening, said apparatus comprising:

pivot bolt support means engaging the handgrip framework of the handgun;

a pivot bolt laterally extending through said opening of said framework, said pivot bolt supported by said support means; and a holster and handgrip extension member pivotally engaging said pivot bolt, said member defining a handgrip extension when pivoted to an open operational mode and defining a holster covering the trigger and barrel of the handgun when pivoted to a closed non-operational mode.

2. The apparatus as described in claim 1 wherein said support means comprises two plate members, each plate member located on an opposing side of and within the handgrip opening and each plate member having a pivot bolt aperture in alignment with the pivot bolt aperture of the opposing plate member for placement of said pivot bolt therethrough.

3. The apparatus as described in claim 2 wherein each of said plate members have an exterior planar surface flush with the exterior side surface of the handgrip framework and said support means further comprising a separator member located between each of said plate members for holding the plate members in spaced orientation relative to one another and said separator member provided with an aperture for receiving said pivot bolt.

4. The apparatus as described in claim 1 wherein said holster and handgrip extension member includes a rigid shell having a pair of oppositely disposed pivot bolt apertures for receiving said pivot bolt and having a top opening longitudinal slot for receiving the handgun handgrip, trigger, and barrel when in the closed non-operational mode.

5. The apparatus as described in claim 4 wherein said holster and handgrip extension member includes a recess in the top of said shell and transverse to said longitudinal slot for receiving one or more fingers of the operator when in an open operational mode.

6. The apparatus as described in claim 4 further comprising a clip fastener affixed to the side of said holster and handgrip extension member for attaching the apparatus to the person.

7. The apparatus as described in claim 4 further comprising lock means for locking the shell in a closed position to prevent operation of the handgun.

8. Holster and handgrip extension apparatus for miniature revolvers of the type having a handgrip framework, to which handgrip side plates are removably attached, said framework defining an opening therethrough, said apparatus comprising:

pivot bolt support means including a pair of oppositely disposed plates locatable within the opening of said handgrip framework and a separator to hold said plates in parallel orientation with one another, the exterior surface of each of said plates being flush with a respective side of the handgrip;

a pivot bolt supported by said support means; and a holster and handgrip extension member pivotally engaging said bolt, said member comprising a rigid shell having a longitudinal top opening slot for receiving the handgrip, the barrel, the trigger, and a portion of the stock of said handgun when in the closed position and said shell including a modified U-shaped recess, transverse to said longitudinal slot, for enclosing the front of the rotating chamber of the handgun when in the closed position and for providing a finger receiving opening in the shell when said holster and handgrip extension member is in the open, handgrip extension, position.

9. The apparatus as described in claim 8 further comprising a clip fastener affixed to said shell for attachment of the apparatus and handgun to the person.

10. The apparatus as described in claim 8 further comprising lock means for locking the handgun in a closed holster position relative to said shell.

* * * * *